United States Patent [19]

Mondini et al.

[11] Patent Number: 5,062,183

[45] **Date of Patent: * Nov. 5, 1991**

[54] LAP FEED PLATE CONNECTED TO OSCILLATING NIPPERS IN A COMBING MACHINE

[75] Inventors: Gian-Carlo Mondini; Walter Ackeret, both of Winterthur, Switzerland

[73] Assignee: Rieter Machine Works Limited, Winterthur, Switzerland

[ * ] Notice: The portion of the term of this patent subsequent to May 29, 2007 has been disclaimed.

[21] Appl. No.: 550,998

[22] Filed: Jul. 11, 1990

[30] Foreign Application Priority Data

Jul. 20, 1989 [CH] Switzerland ..... 2711/89

[51] Int. Cl.[5] ..... D01G 19/16

[52] U.S. Cl. ..... 19/225; 19/227; 19/235

[58] Field of Search ..... 19/225, 226, 235; 16/225, 226

[56] References Cited

U.S. PATENT DOCUMENTS

| | | | |
|---|---|---|---|
| 2,526,129 | 10/1950 | Groesbeck et al. | 16/225 |
| 2,690,799 | 10/1954 | Gerstenmaier | 16/225 X |
| 2,978,020 | 4/1961 | Paulsrude | 16/225 X |
| 3,343,867 | 9/1967 | Couch et al. | 16/225 X |
| 3,514,989 | 6/1970 | Robinson | 16/225 X |
| 3,574,306 | 4/1971 | Alden | 16/225 X |
| 3,881,303 | 5/1975 | Krafka et al. | 16/225 X |
| 4,369,715 | 1/1983 | Ingersoll et al. | 16/226 X |
| 4,658,472 | 4/1987 | Grenier | 16/225 |
| 4,670,938 | 6/1987 | Fowlston | 16/225 |
| 4,928,357 | 5/1990 | Clement | 19/225 |

FOREIGN PATENT DOCUMENTS

| | | |
|---|---|---|
| 868865 | 3/1953 | Fed. Rep. of Germany . |
| 2612329 | 10/1977 | Fed. Rep. of Germany . |
| 2401593 | 3/1979 | France . |
| 1414578 | 11/1975 | United Kingdom . |

OTHER PUBLICATIONS

Copy of the European Search Report.

*Primary Examiner*—Werner H. Schroeder
*Assistant Examiner*—John J. Calvers
*Attorney, Agent, or Firm*—Sandler, Greenblum & Bernstein

[57] ABSTRACT

The batt or sheet to be combed is unwound by rotation of a lap roller (1) from a lap disposed thereon. The batt goes from the lap roller (1) by way of the lap feed plate (13) to a feed cylinder (10) mounted in oscillating nippers (6, 8). The feed plate (13) is connected by way of its bottom edge to the oscillating nippers (6, 8) and by way of its top edge to an element (16) which is rigidly secured to the frame and disposed near the lap roller (1). The plate (13) is made of plastics and has a reduced thickness between the two edges in a linear bend zone (18) which is parallel to the edges. The bend zone (18) extends over the whole width of the plate (13) and acts as an articulation. The plate (13) is therefore simple and economical to produce. It requires no hinge between the two edges; also, it is of reduced weight.

13 Claims, 3 Drawing Sheets

LAP FEED PLATE CONNECTED TO OSCILLATING NIPPERS IN A COMBING MACHINE

BACKGROUND OF THE INVENTION

1. Field of the Invention
2. Description of Background and other Information

The invention relates to a lap feed plate connected to oscillating nippers in a combing machine and effective to guide the lap to be combed, the same being fed to a feed roller mounted in the nippers.

Combing machines are known in which a lap feed plate made of sheet metal is pivotally connected by way of a first edge to the nippers and by way of a second edge and a hinge having pivot pins to an edge of a second plate whose other edge is pivotally connected to an element rigidly secured to the frame and disposed near a lap roller of the combing machine. The function of the two pivotally interconnected feed plates is to maintain substantially constant the distance travelled by the lap, which is unwound by rotation of the lap roller from a coiled lap thereon, despite variations in the distance between such roller and the feed roller due to the movement of the nippers, and to obviate flutter and misdrafting of the lap.

A disadvantage of these known lap feed plates is that, particularly at the high operating speeds or combing cycle rates required nowadays, the hinge bearings wear out after a short period of operation, with the result of excessive play and excessive noise.

SUMMARY OF THE INVENTION

It is the object of the invention to provide a lap feed plate of the kind specified which helps to obviate this disadvantage and which can operate satisfactorily for a long period even at high combing cycle rates, for example, of from 300 to 350 a minute.

The lap feed plate according to the invention which solves the problem is distinguished in that the plate is made of plastic, is connected by way of a first edge to the oscillating nippers and by way of a second edge to an element rigidly secured to the frame and disposed near a lap roller of the combing machine, and has a reduced thickness between the two edges in at least one linear bend zone which extends substantially parallel to the edges and over the whole width of the plate.

The bending zone provides a pivotal connection between two parts of the unitary lap feed plate. The plate can have additional bending zones at its two edges or be pivotally connected to the nippers or to the frame-connected element in some other way so as to have basically the same effect as the two known guide plates pivotally interconnected by a hinge.

To enhance strength and working life, the plate can, conveniently, be made of a fibre-reinforced plastics (fibre composite), preferably of a carbon-fibre-reinforced plastics. Also, a woven reinforcement can be incorporated in the plate in the bend zone.

BRIEF DESCRIPTION OF THE DRAWINGS

Embodiments of the invention will be described in greater detail hereinafter with reference to the drawings wherein.

DETAILED DESCRIPTION OF THE PREFERRED EMBODIMENTS

Figure 1:
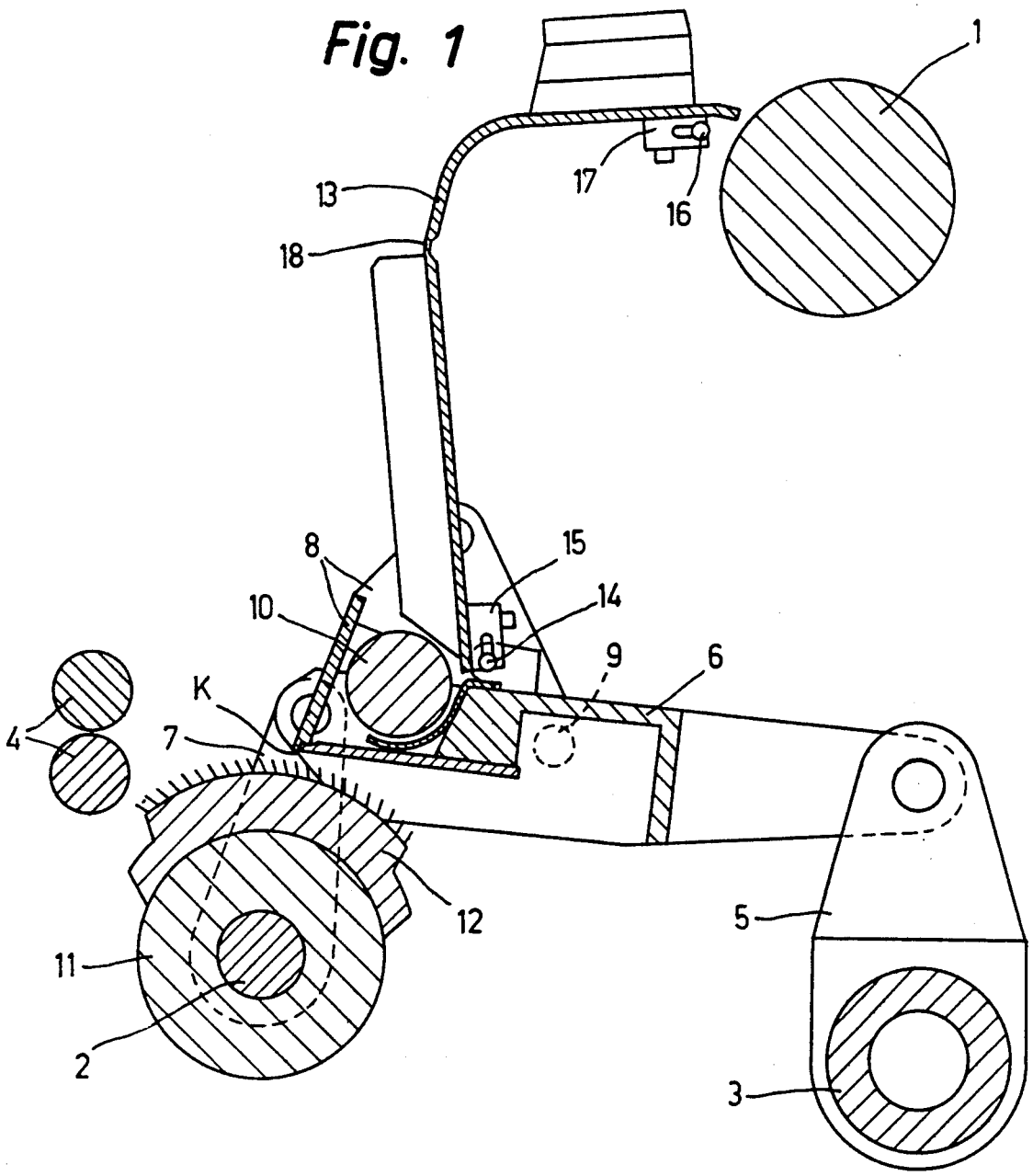
FIG. 1 is a diagrammatic view in vertical section showing parts of a combing head of a combing machine.
Figure 2:
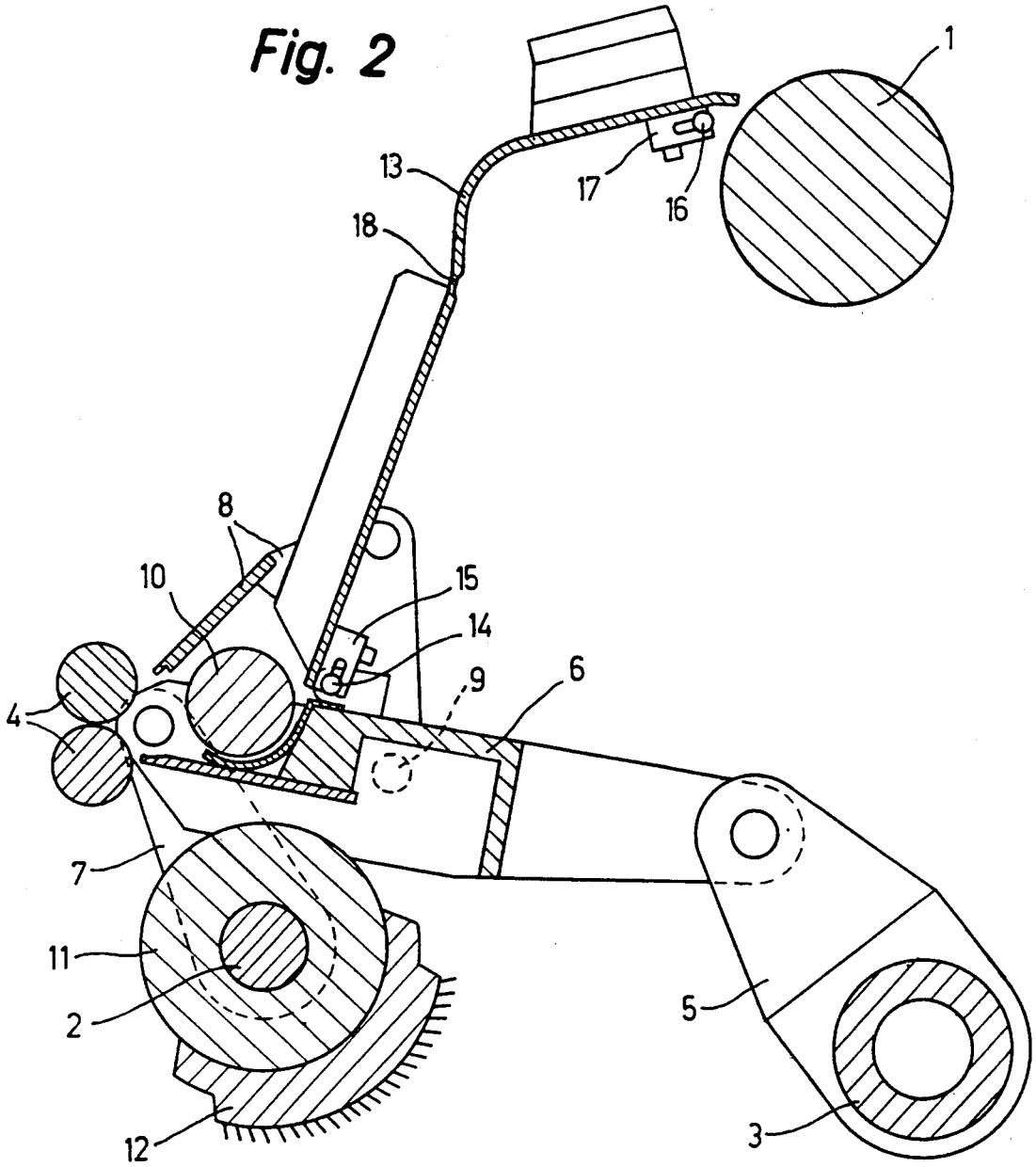
FIG. 2 shows the same section as FIG. 1 but with the parts in a different position.

The combing head shown in FIGS. 1 and 2 has a rotating lap roller 1, a rotating cylinder shaft 2, a nipper shaft 3 rotatable in reciprocation and two detaching rollers 4, all mounted in a machine frame (not shown). The nipper shaft 3, which reciprocates between the position shown in FIG. 1 and the position shown in FIG. 2, carries crank arms 5 to which the rear end of a lower nipper 6 is articulated. The front end of lower nipper 6 is articulated to front supports 7 mounted for pivoting around the axis of the shaft 2. An upper nipper 8 co-operates with the lower nipper 6 and is connected thereto for pivoting around a pin 9.

The continuously rotating shaft 2 carries in conventional manner a cylinder 11 having a segment 12 which has combing pins.

The lap which is to be combed and which has a width, for example, of approximately 30 cm, is carried on roller 1 in the form of a coil (not shown). The lap unwinds from the coil as a result of the roller 1 rotating, goes to a feed plate 13 and moves thereon to feed roller 10 and therefrom into nip K (FIG. 1) between the lower nipper 6 and the upper nipper 8.

When the lower nipper 6 is in the withdrawn position shown in FIG. 1, the nippers 6, 8 are in the closed state and the lap is clamped fast in the nip K. A tuft projecting from the nip K is combed out by the rotating segment 12, whereafter the lower nipper 6 advances into the position shown in FIG. 2, the nippers 6, 8 opening. The combed-out tuft is taken over by the detaching rollers 4 and drawn through a top comb (not shown), whereafter the lower nipper 6 returns to its withdrawn or retracted position and the cycle restarts.

The feed plate 13 ensures that the path of the lap between the lap roller 1 and the feed roller 10 always remains of the same length during the movement described of the lower nipper 6 and, therefore, of the feed roller 10. The feed plate 13 is made of plastics, preferably a fibre-reinforced plastic, more particularly a carbon-fibre-reinforced plastic. The bottom edge of the feed plate 13 is pivotally connected to the lower nipper 6. In the embodiment shown at least one spindle 14 is retained on the lower nipper 6 and is mounted in at least one member 15 which is secured to the feed plate 13 and which is a snap fit on the spindle 14. The same can extend over the whole width of the feed plate 13 and be mounted in one or more members 15 secured to the feed plate 13. Alternatively, shorter spindles 14 associated one each with the two lateral edges of the feed plate 13 can be retained on the lower nipper 6 and a member 15 can be snap-fitted on each such spindle 14. The arrangement of the spindles 14 and of the snap-fitted members 15 thereon could of course be inverted—i.e., the spindles 14 could be secured to the plate 13 and the members 15 to the lower nipper 6.

The top edge of the guide plate 13 is pivotally connected to a frame-connected element 16 disposed near the lap roller 1. In the embodiment shown this pivoted connection is similar to the pivoted connection between the bottom edge of the plate 13 and the lower nipper 6. The member 16 rigidly connected to the frame is embodied by at least one spindle mounted in at least one member 17 secured to the feed plate 13, the member 17 being a snap fit on the latter spindle.

Between its top edge and its bottom edge the plate 13 has a linear bend zone 18 which extends substantially parallel to such edges and in which the thickness of the plate 13 is reduced. The bend zone 18, which extends over the whole width of the feed plate 13 (perpendicularly to the plane of the drawing), acts as an articulation pivotally interconnecting the top and bottom parts of the plate 13.

Figure 3:
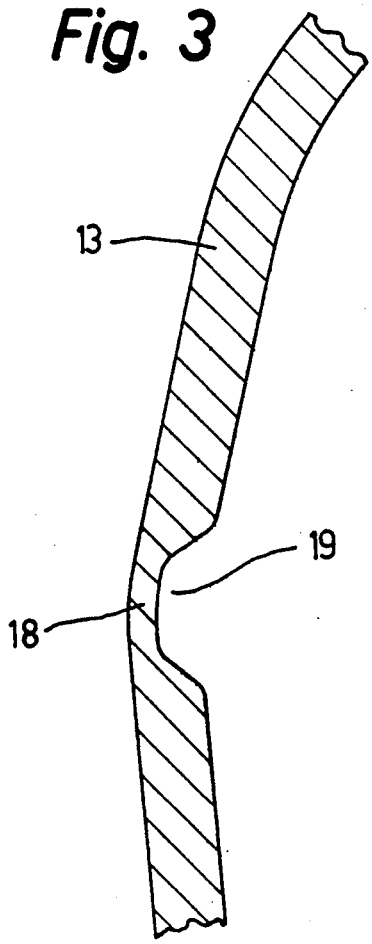
FIG. 3 is a view to an enlarged scale of a bending zone of a lap feed plate of the combing head shown in FIGS. 1 and 2.

Bend zone 18 of the plate 13 is shown to an enlarged scale in FIG. 3. The bend zone 18 is in the form of a recess or groove 19 disposed, preferably as shown, in the back of the plate 13, the back being remote from the fiber sheet or batt, so that the front of the guide plate 13 which guides the batt or sheet is smooth throughout.

Figure 4:
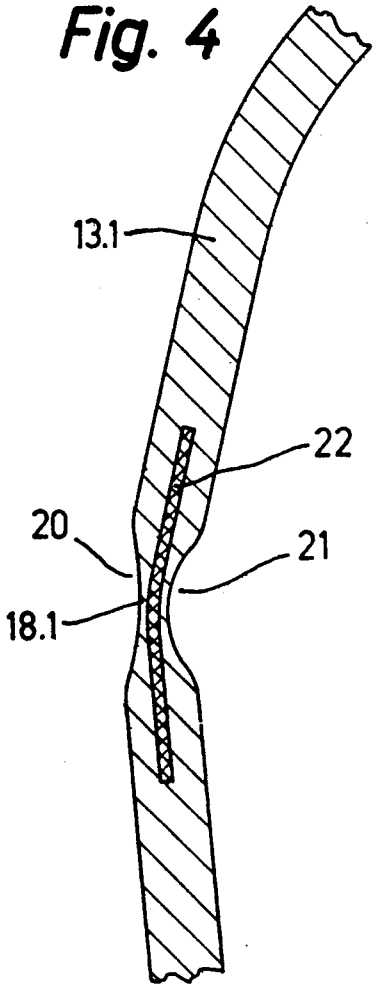
FIG. 4 is a view similar to FIG. 3 of a differently devised bend zone.

Alternatively, of course, two shallow recesses opposite one another in both sides of the feed plate 13 can help to form the bending zone. FIG. 4 shows a part of a guide plate 13.1 in which the bend zone 18.1 is formed by two such recesses 20, 21.

As FIG. 4 also shows, a woven strip 22 can be incorporated as a reinforcing insert in the bend zone 18.1 of the feed plate 13.1 without impairing the flexibility of the zone 18.1. A fabric reinforcement of this kind could also be present in the bend zone 18 shown in FIG. 3.

As previously stated, the plate 13 (or 13.1) can, conveniently, be made of fibre-reinforced plastic. In this event the reinforcing fibres should preferably not be interrupted by the recess 19 (or 20, 21) in the bend zone 18 (or 18.1)—i.e., the recess 19 (or 20, 21) should not be contrived by chip-removal treatment of the feed plate 13 (or 13.1) but should be contrived by embossing or impressing the recess in the feed plate before complete hardening of the fibre-reinforced plastic.

Figure 5:
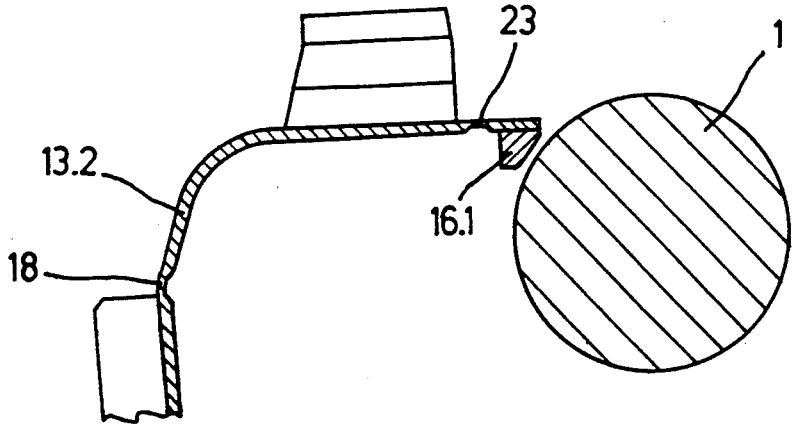
FIG. 5 shows a variant of a detail of FIG. 1.

FIG. 5 is a view in side elevation, corresponding to a part of FIG. 1, of a variant in which the feed plate 13.2 has not only the bend zone 18 but also a second identical bend zone 23 at its top edge. The top part of the feed plate 13.2 between the bend zones 18 and 23 is pivotally connected by the bend zone 23 to the top edge part of the feed plate 13.2 so that such top edge part can be non-movably secured to an element 16.1 rigidly secured to the frame.

Similarly, the feed plate 13 (or 13.1 or 13.2) might have at its bottom edge an additional bend zone identical to the bend zone 18 (or 18.1), in which event the bottom edge part of the guide plate below the additional bend zone might be non-movably connected to the lower nipper 6.

What is claimed is:

1. A lap feed plate connected to oscillating nippers in a combing machine having a frame, and effective to guide the lap to be combed which is fed to a feed roller mounted in the nippers, wherein said lap feed plate includes a single sheet of plastic and has a first edge connected to the oscillating nippers and a second edge connected to an element secured to said frame and disposed near a lap roller of the combing machine, and wherein said lap feed plate has a reduced thickness between said two edges in at least one linear bend zone which extends substantially parallel to said edges and over the entire width of the plate, said reduced thickness allowing said nippers to oscillate at a high combing cycle rate.

2. A lap feed plate as claimed in claim 1, wherein said plate is pivotally connected to said frame-connected element and to said nippers.

3. A lap feed plate as claimed in claim 2, wherein at least one of said pivotal connections includes at least one spindle and at least one member which is a snap fit on said spindle and in which said spindle is journalled.

4. A lap feed plate as claimed in claim 1, wherein said plate also has a reduced thickness in at least one further linear bend zone which extends substantially parallel to said edges and over the entire width of the plate near at least one of said edges.

5. A lap feed plate as claimed in claim 1, wherein said plate is made of fiber-reinforced plastic.

6. A lap feed plate as claimed in claim 5, wherein said plate is made of carbon-fiber-reinforced plastic.

7. A lap feed plate as claimed in claim 5, wherein said bend zone is produced by pressing so that the reinforcing fibers in the bend zone are not interrupted.

8. A lap feed plate as claimed in claim 1, wherein a woven reinforcement fabric is incorporated in said plate in said bend zone.

9. A lap feed plate as claimed in claim 1, wherein said bend zone is formed by a recess in the back of said plate, said back being remote from the lap.

10. A lap feed plate connected to oscillating nippers in a combing machine having a frame, and effective to guide the lap to be combed which is fed to a feed roller mounted in the nippers, wherein said lap feed plate includes a single sheet of fiber-reinforced plastic and has a first edge connected to the oscillating nippers and a second edge connected to an element secured to said frame and disposed near a lap roller of the combing machine, and wherein said lap feed plate has a reduced thickness between said two edges in at least one linear bend zone which extends substantially parallel to said edges and over the entire width of the plate.

11. A lap feed plate connected to oscillating nippers in a combing machine having a frame, and effective to guide the lap to be combed which is fed to a feed roller mounted in the nippers, wherein said lap feed plate includes a single sheet of plastic and has a first edge connected to the oscillating nippers and a second edge connected to an element secured to said frame and disposed near a lap roller of the combing machine, and wherein said lap feed plate has a reduced thickness between said two edges in at least one linear bend zone which extend substantially parallel to said edges and over the entire width of the plate, a woven reinforcement fabric being incorporated in said plate in said bend zone.

12. A lap feed plate as claimed in claim 1, wherein said high combing cycle rate is at least substantially 300 cycles per minute.

13. A lap feed plate as claimed in claim 12, wherein said high combing cycle rate is from substantially 300 cycles per minute to 350 cycles per minute.

* * * * *